United States Patent [19]

Tsutsumi et al.

[11] 4,306,827

[45] Dec. 22, 1981

[54] APPARATUS FOR DISTRIBUTING MATERIALS INTO VERTICAL TYPE FURNACE

[75] Inventors: Teruo Tsutsumi; Kazumi Inoue; Shuji Asami, all of Yokohama; Masayuki Kohmoto, Yokosuka; Toshiyuki Nasu, Ichikawa; Yoshio Seo; Toshio Yasusaka, both of Yokohama, all of Japan

[73] Assignee: Ishikawajima-Harima Jukogyo Kabushiki Kaisha, Tokyo, Japan

[21] Appl. No.: 160,962

[22] Filed: Jun. 19, 1980

[30] Foreign Application Priority Data

Nov. 13, 1979 [JP] Japan ..... 54-146719

[51] Int. Cl.[3] ..... F27B 1/20

[52] U.S. Cl. ..... 414/160; 193/16; 266/176

[58] Field of Search ..... 414/293, 299, 300, 301, 414/160, 199, 205, 206, 208; 266/176, 183; 193/16, 17

[56] References Cited

U.S. PATENT DOCUMENTS 4,042,130 8/1977 Legille et al. ..... 266/183 X 4,243,351 1/1981 Legille et al. ..... 414/206

*Primary Examiner*—Robert G. Sheridan

*Attorney, Agent, or Firm*—B. B. Olive

[57] ABSTRACT

An apparatus for distributing materials into a blast furnace using no bell. The apparatus has a material distributing hopper disposed for a rocking motion around the central axis of said furnace. The rocking motion of the material distributing hopper is caused by an axial movement and rotation of a single drive shaft disposed outside the furnace.

7 Claims, 10 Drawing Figures

APPARATUS FOR DISTRIBUTING MATERIALS INTO VERTICAL TYPE FURNACE

BACKGROUND OF THE INVENTION

The present invention relates to an apparatus for distributing materials to a vertical type furnace, particularly to a blast furnace.

Hitherto, there have been proposed some material distributing apparatus for blast furnace using no bell. However, no material distributing apparatus having a rockable material distributing hopper has been put into practical use. An example of the apparatus having rockable material distributing hopper is shown in Japanese Patent Publication No. 13722/1976, in which a gear box disposed in the furnace is supported by the casing of the furnace through a rocker shaft. A cylinder supporting the material distributing hopper is supported by the gear box through the medium of a shaft which extends in the direction perpendicular to the aforementioned rocker shaft. The shaft has a pinion which engages a ring gear disposed in the gear box and adapted to be driven by a drive shaft extended from the outside of the furnace. As the ring gear is rotatively driven by the drive shaft, the material distributing hopper rocks in one direction and, as the rocker shaft is rotated, the distributing hopper together with the gear box rocks in a direction perpendicular to the aforementioned rocking direction.

In this known system, since a two-shaft driving system is adopted to realize a desired pattern of material distribution into the furnace, a difficult problem is posed concerning the synchronous driving of the two shafts. Also, the driving method is the repetitional driving, i.e. rocking, so that a considerably large impact is given to the apparatus. Further, in order to sufficiently cool down the gear box in the furnace, it is necessary to circulate a cooling gas at a large rate, resulting in a raised running cost. Even by this cooling, the fear of thermal distortion of the gear box and, hence, the operation failure of the same cannot be eliminated completely. Also, a troublesome work is required for the protective maintenance of the gears.

It is, therefore, a major object of the invention to overcome the above-described problems of the prior art.

The above and other objects, as well as advantageous features of the invention will become clear from the following description of the preferred embodiments taken in conjunction with the accompanying drawings.

DETAILED DESCRIPTION OF THE PREFERRED EMBODIMENTS

Figure 1:
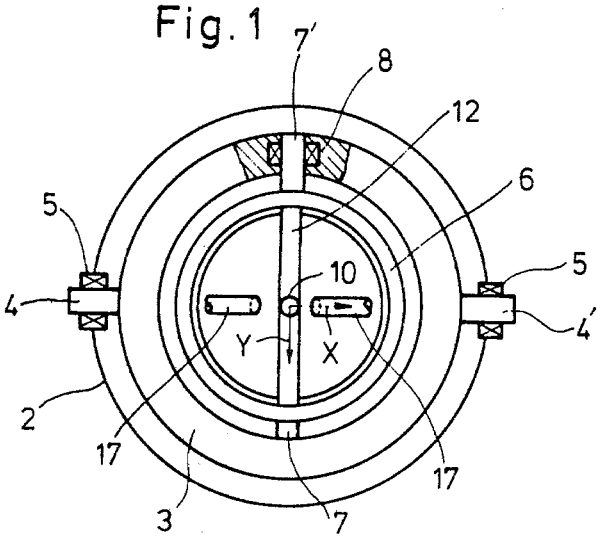
FIG. 1 is a schematic plan view of a material distribution apparatus of the invention for distributing materials into a vertical type furnace.
Figure 2:
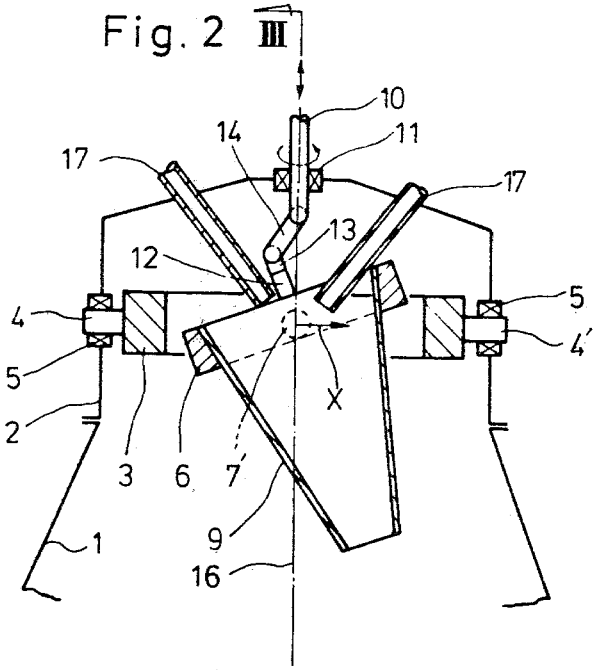
FIG. 2 is a sectional front elevational view of the apparatus shown in FIG. 1.
Figure 3:
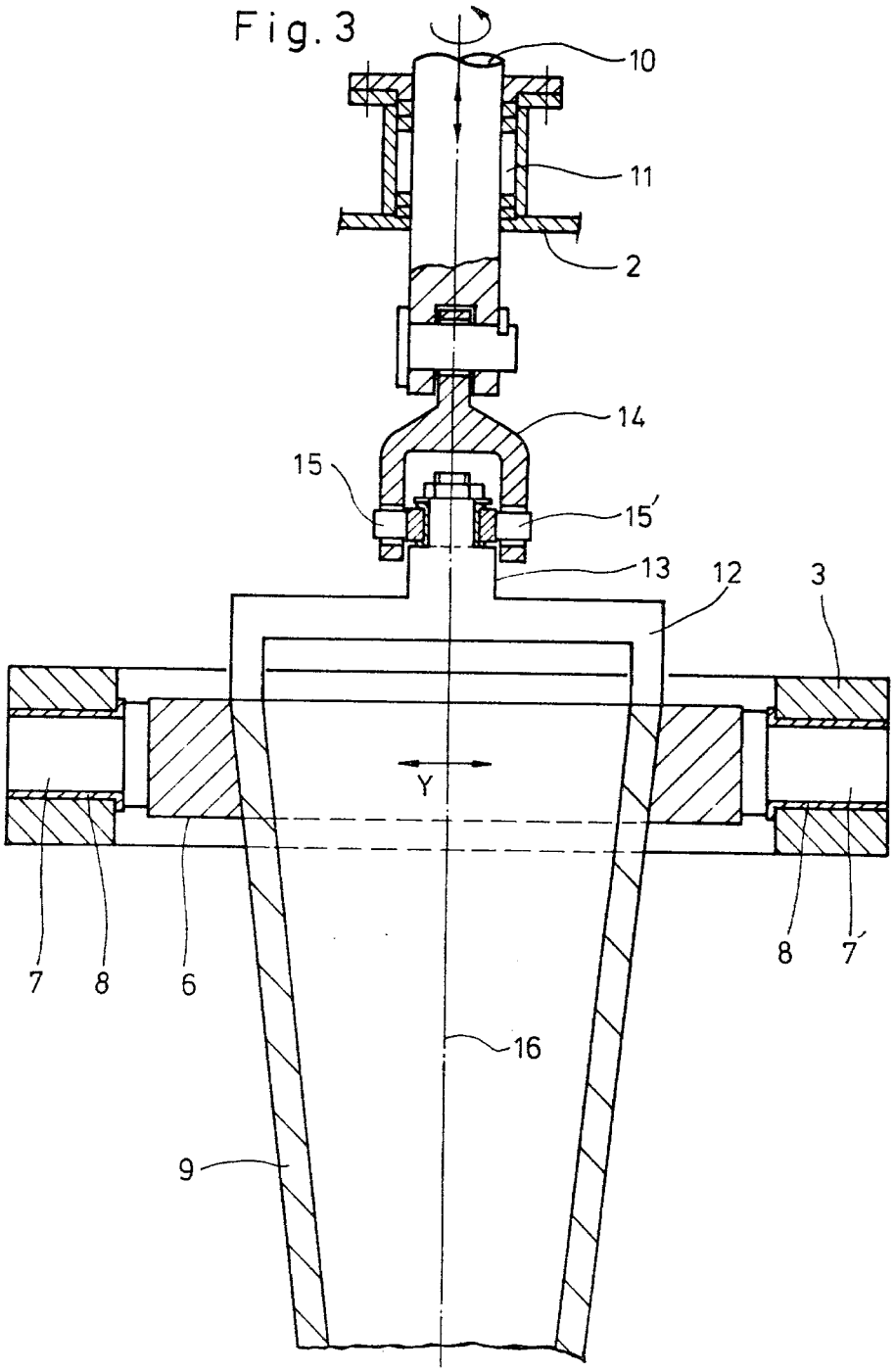
FIG. 3 is an enlarged sectional view of the apparatus shown in the direction of arrow III in FIG. 2.

Referring first to FIGS. 1 to 3 showing a first embodiment of the invention, a casing 2 is unitarily attached to the top of a furnace body 1. A ring-shaped frame 3 provided at its opposing walls with rocker shafts 4,4' is rotatably (rockably) carried by the casing 2 by the rocker shafts 4,4' received by bearings 5 provided on the side walls of the casing 2. A ring-shaped hopper support member 6 having rocker shafts 7,7' extending in the direction (Y-direction) perpendicular to the direction (X-direction) of the line interconnecting the rocker shafts 4,4' is disposed in the frame 3. The rocker shafts 7,7' are supported by bearings 8 provided on the frame 3 as shown in FIGS. 1 and 3, so that the material distributing hopper support member 6 is rockable by means of the rocker shafts 7,7'. A material distributing hopper 9 the inner peripheral surface of which is lined with a wear-resistant material is dropped and fitted into the support member 6. The arrangement is such that the material distributing hopper 9 rocks around the X-axis as the frame 3 rocks, and rocks or tilts around the Y-axis as the hopper support member 6 rocks. A vertical drive shaft 10 is disposed above the material distributing hopper 9 and is connected to a gear (not shown) provided outside the furnace. In the described embodiment, this drive shaft 10 is disposed on the central axis 16 of the furnace and rotatably supported by a bearing 11 in such a manner as to be able to move up and down through the top of the casing 2.

A hopper shaft 12 disposed on the line interconnecting the shafts 7,7' and fixed to the hopper support member 6 is fixed at a position above the material distributing hopper 9, and an upwardly extending journal portion 13 is provided at the central portion of the shaft 12 on the axis of the hopper 9. As shown in FIG. 3, the journal portion 13 is connected, through a medium of shafts 15,15' engaging for rotation around the journal portion 13, to one end of a connecting member 14 which is pivoted at its other end to the lower end of the drive shaft 10 for bending motion in only one direction, so as to be freely tilted in the direction perpendicular to the hopper shaft 12 and to transmit the driving power from the driving shaft 10 to the material distributing hopper 9, through the rotary tilting motion of the connecting member 14 with respect to the journal portion 13.

The furnace gas is sealed at the bearings 5, 11. A reference numeral 17 denotes a material throw-in port which is extended through the casing 2 to a position above the material distributing hopper 9 from the outside of the furnace.

In the operation of the material distributing apparatus having the described construction, as the drive shaft 10 is driven by an external gear with the connecting member 14 bent to tilt the material distributing hopper 9 at a desired angle of inclination, the connecting member 14 rotates around the axis of the drive shaft 10 keeping its bent posture. Since the connecting member 14 is rotatably engaged at its bottom by the journal portion 13 of the hopper shaft 12, the connecting member 14 makes a circular movement while rotating around the journal portion 13. In consequence, the hopper shaft 12 makes a rocking motion similar to that of a wooden pestle, around a point of intersection of a line interconnecting the shaft 4,4' and a line interconnecting the shafts 7,7'. Meanwhile, the frame 3 rocks around the X-axis by means of the shafts 4,4', while the hopper support member 6 rocks around the Y-axis by means of the shafts 7,7'. Thanks to these rocking motions, the above-mentioned wooden pestle motion is achieved smoothly and the lower end of the material distributing hopper 9 scribes a circle to distribute the material along the circular line.

As a motion is imparted to shift the drive shaft 10 in the axial direction, a tilting motion is added to the circular movement of the material distributing hopper 9 so that the radius of the circle scribed by the hopper end is changed to permit a uniform distribution of the material.

Subsequently, as the drive shaft 10 is moved only in the axial direction, after stopping thereof, the material distributing hopper 9 makes a rocking motion around the Y-axis together with the hopper support member 6, through the action of the hopper shaft 12. In consequence, the angle of inclination to the central axis of the furnace can be changed as desired to make it possible to distribute the material in the radial direction of the furnace.

The material distributing hopper 9, capable of performing the above-described movement, can distribute the material in any desired pattern including circular pattern.

Figure 4:
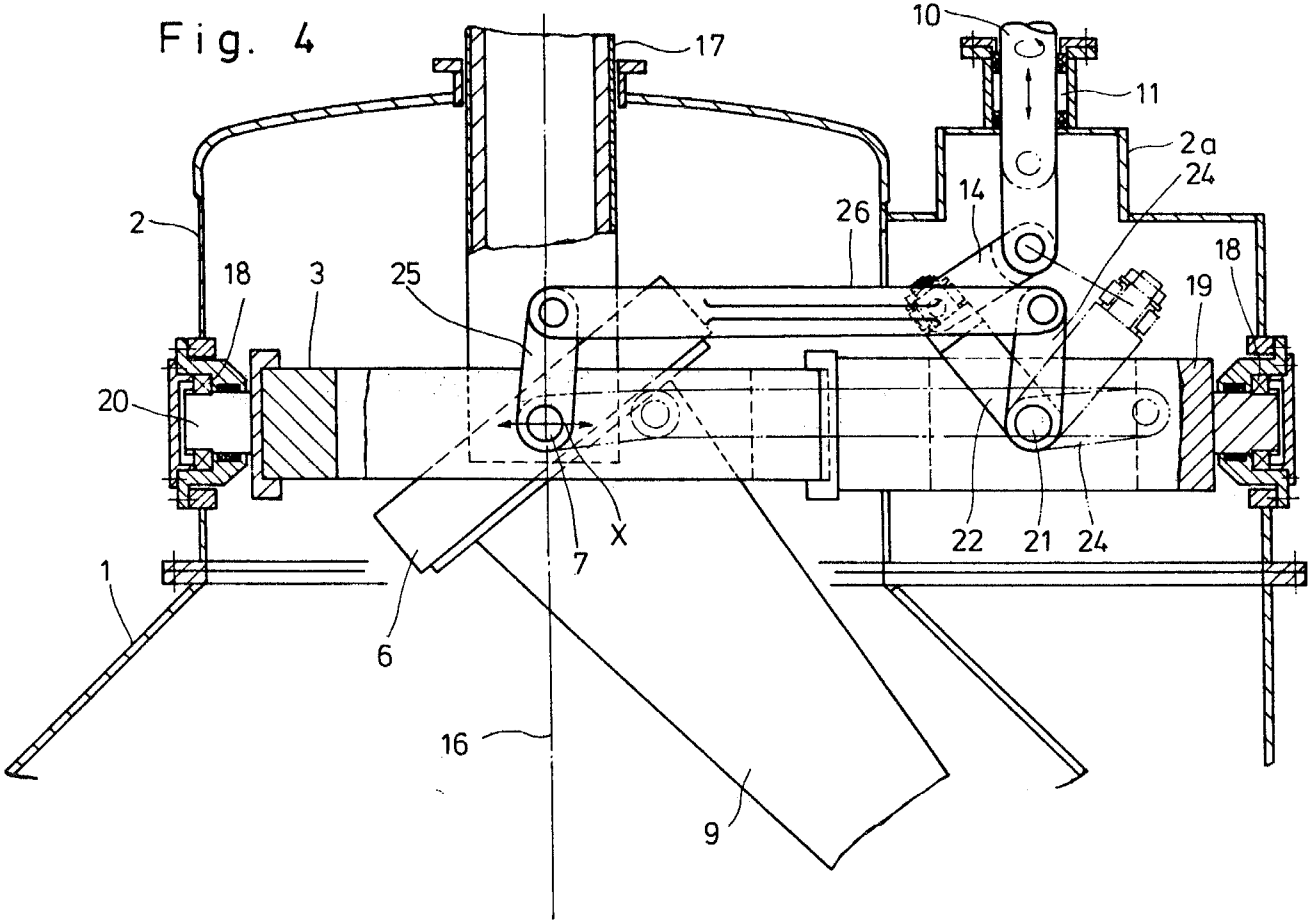
FIG. 4 is a partial front elevational view of a material distributing apparatus of another embodiment of the invention.
Figure 5:
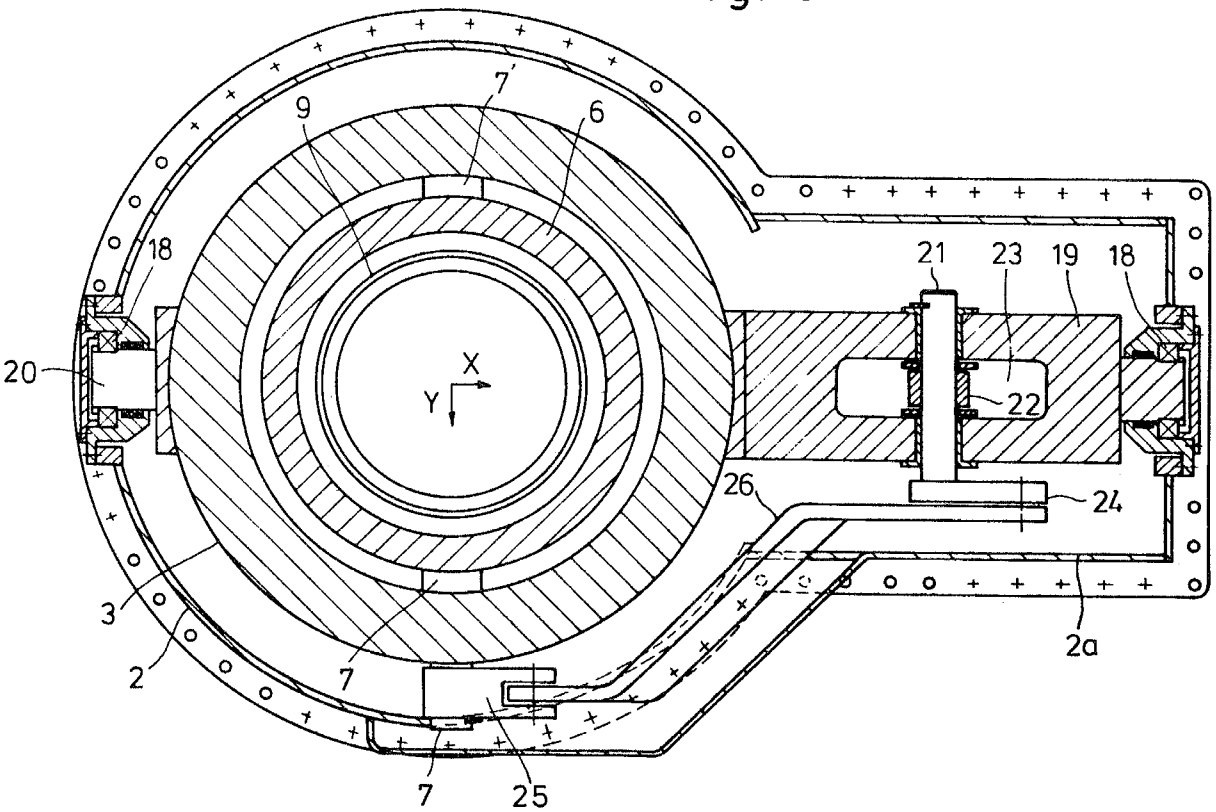
FIG. 5 is a sectional plan view of the apparatus shown in FIG. 4.
Figure 6:
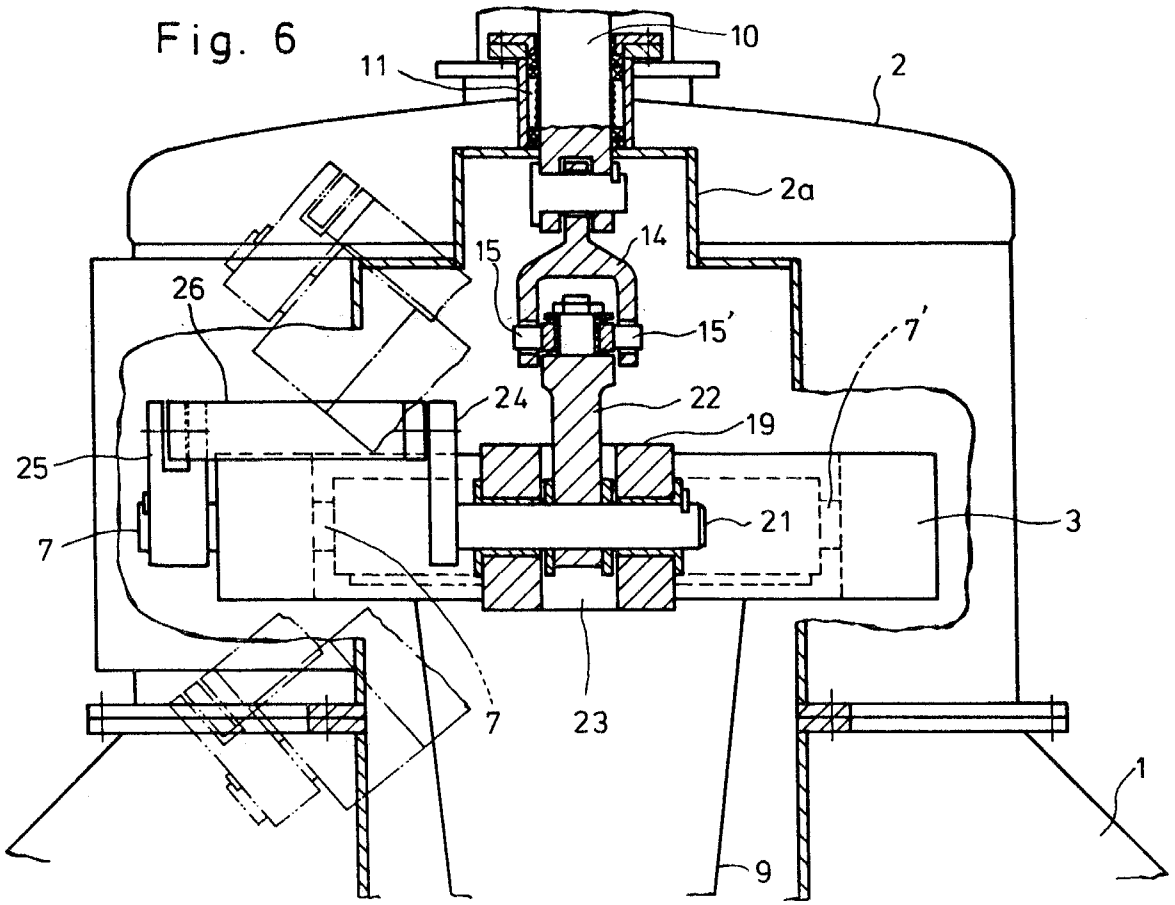
FIG. 6 is a sectional side elevational view for explaining the driving power transmitting section.

FIGS. 4 to 6 in combination show another embodiment of the invention in which the drive shaft 10 is offset from the central axis 16 of the furnace and is connected to the material distributing hopper 9 through a link mechanism to realize the motion of the hopper similar to that of the first embodiment.

To explain in more detail, a material throw-in port 17 is disposed in the center of the top of casing 2 in a vertical posture to reach the upper end of the material distributing hopper 9. An additional casing **2*a* is attached to one side of the casing 2 and the interiors of the casing 2 and the additional casing 2*a* are communicated with each other. Bearings 18 are mounted on the casing 2 and the additional casing 2*a* so as to oppose each other across the central axis of the furnace. A frame 3 disposed on the central axis of the furnace is rockably (rotatably) carried through rocker shafts 19, 20. The frame 3 accomodates a material hopper supporting member 6 the opposite outer surfaces of which are provided with rocker shafts 7,7' projected such that the line interconnecting these rocker shaft 7,7' intersects the line (X-axis) connecting the axes of the shafts 19, 20 at a right angle on a point on the central axis 16** of the furnace.

As in the case of the embodiment shown in FIGS. 1 to 3, the material distributing hopper support member 6 is carried by the frame 3 and fittingly receives the material distributing hopper 9 dropped thereinto from the upper side. A horizontal shaft 21 which intersects the shaft 19 at a right angle extends through an intermediate portion of the shaft 19. To the intermediate portion of the horizontal shaft 21, the lower end of a power transmission shaft 22 is fixed making use of the space 23 (See FIGS. 5 and 6) of the shaft 19. A lever 24 is fixed to one end of the horizontal shaft 21. Also, the lower end of a vertical drive shaft 10, which is supported in the casing **2*a* rotatably and vertically movably by the bearing 11, is connected rotatably and for free bending through the connecting member 14 and the shafts 15,15' to the power transmission shaft 22 in the same manner as the first embodiment shown in FIG. 3**.

One 7 of the shafts fixed to the material supporting member 6 is extended to the outside of the frame 3 and a lever 25 of the same length as the lever 24 is fixed at the same inclination angle to the projected shaft 7. The lever 25 is connected to the lever 24 through a link 26 so that the material distributing hopper 9 is driven by the power transmitted through the drive shaft 10.

In this embodiment, as the drive shaft 10 is moved up and down, the power transmission shaft 22 together with the horizontal shaft 21 is tilted through the bending motion at the connecting portion between the connecting member 14 and the power transmission shaft 22, so that the lever 24 unitary with the shaft 21 is rotated concurrently. As a result of this movement, the lever 25 is rotated in the same direction by the same angle through the action of the link 26, so that the material distributing hopper 9 is tilted together with the hopper supporting member 6. In consequence, the material thrown into the hopper through the thrown-in port 17 is distributed in the radial direction of the furnace.

As the driving power is applied to the drive shaft 10 with the material distributing hopper 9 in a tilted state as shown in FIG. 4, the connecting member 14 makes a rotation around the drive shaft 10, so that the power transmission shaft 22 makes a circular movement, i.e. the wooden pestle motion around the point of intersection between itself and the horizontal shaft 21. In consequence, the shaft 19 rocks around X-axis (axis of shaft 19) through the action of the horizontal shaft 21. Simultaneously, the horizontal shaft 21 is rotated and the material distributing hopper 9 rocks around the X-axis together with the frame 3 and the hopper support member through the rocking of the shaft 19. At the same time, the material distributing hopper 9 rocks around the Y-axis by the rotation of the horizontal shaft 21, through the action of the lever 24, link 26 and the lever 25. In consequence, the material distributing hopper 9 rotates around the central axis 16 of the furnace to scribe a circle at its end. It is possible to change as desired the radius of the circle scribed by the end of the material distributing hopper 9. This motion of the material distributing hopper 9 is same as that of the embodiment shown in FIGS. 1 to 3.

Figure 7:
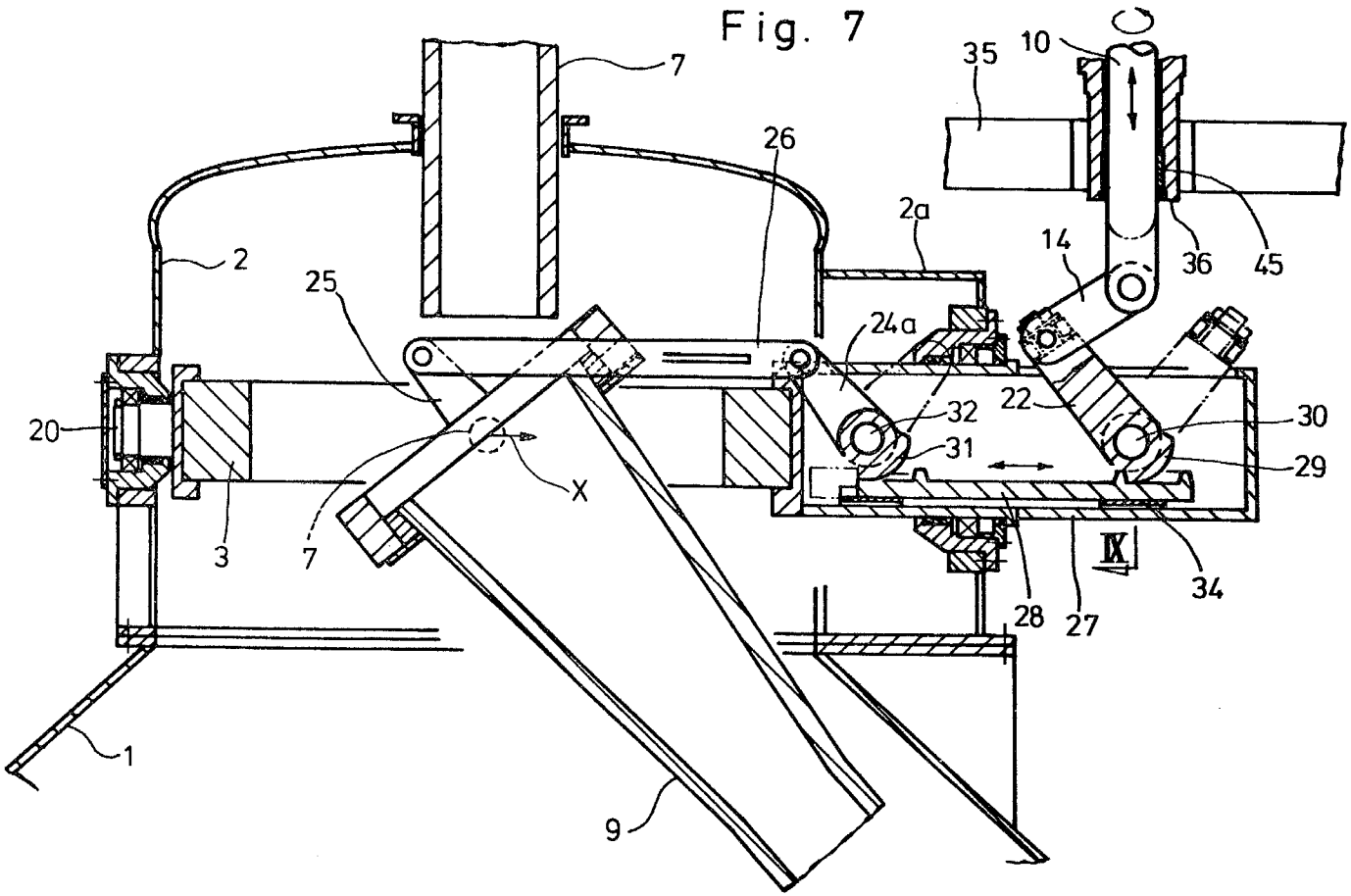
FIG. 7 is a sectional front elevational view of a material distributing apparatus of still another embodiment of the invention.
Figure 8:
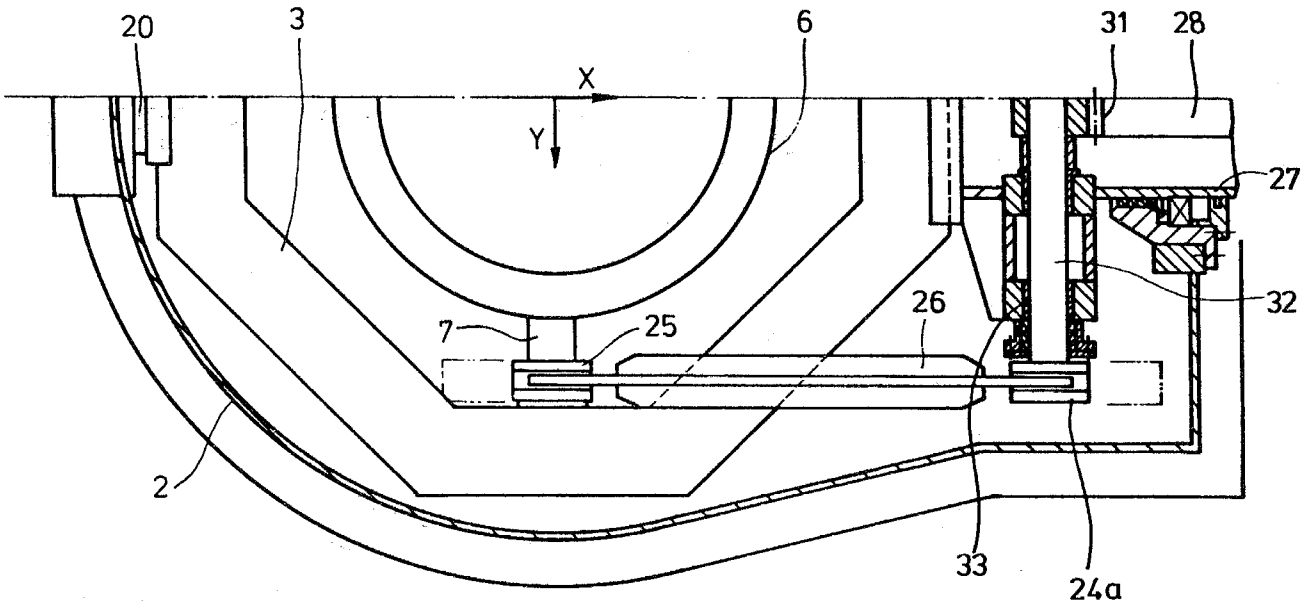
FIG. 8 is a fragmentary sectional view of the interior of the furnace shown in FIG. 7.
Figure 9:
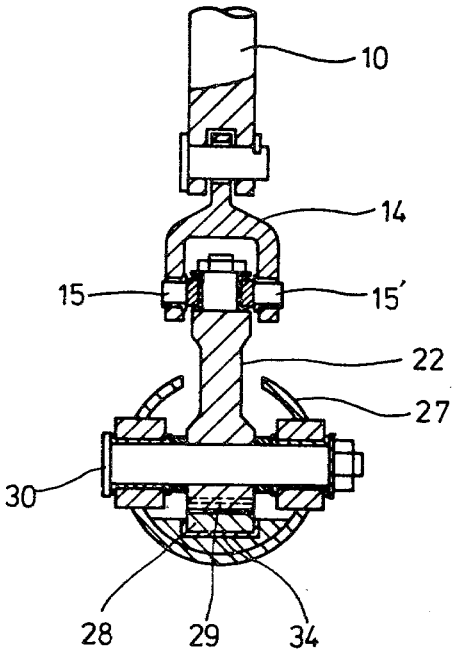
FIG. 9 is a sectional view of the apparatus as viewed in the direction of arrow IX of FIG. 7.

FIGS. 7 to 9 show still another embodiment of the invention which is similar to that shown in FIGS. 4 to 6 but the rocker shaft 19 of the embodiment shown in FIGS. 4 to 6 is substituted by a hollow rocker shaft 27. In addition, the drive shaft 10, connecting member 14 and other associated members are disposed outside the furnace.

To explain in more detail, the hollow rocker shaft 27 is extended to the outside of the casing **2*a* and a rack 28 is provided in the hollow rocker shaft 27 in parallel with the axis of the latter. A sector gear 29 meshing with the rack 28 is provided at the lower end of the power transmission shaft 22. The power transmission shaft 22 is fixed at its lower end to a horizontal shaft 30 which is rotatably supported by the hollow rocker shaft 27. The drive shaft 10 outside the furnace is supported to extend vertically in such a manner as to be able to rotate and move in the axial direction by a boss 36 which is provided on a turret 35. The drive shaft 10 and the power transmission shaft 22 are connected to each other through the connecting member 14 and shafts 15,15'** as in the case of the preceding embodiments.

The portion of the hollow rocker shaft 27 inside the furnace supports a horizontal shaft 32 by a bearing 33. A pinion 31 engaging the aforementioned rack 28 and having the same module and pitch circle diameter as the gear 29 is provided on the mid portion of the shaft 32. One end of the horizontal shaft 32 is extended out of the rocker shaft 27. A lever 24a is fixed to the projected portion of this horizontal shaft 32. The arrangement is such that the pinion 31 is rotated by the movement of the rack 28 which slides on the liner 34 (See FIG. 9), so that the lever 24a is rotated through the rotation of the horizontal shaft 32. The atmosphere in the furnace is sealed from the ambient air by means of seals provided at the bearings 33, while the interior of the shaft 27 is insulated from the atmosphere in the furnace and is communicated with the ambient air. As in the case of the embodiment shown in FIGS. 4 to 6, the lever 24a and the lever 25 which is fixed to one 7 of the rocker shafts of the hopper support member 6 have an equal length and are connected to the common link 26 at an equal angle of inclination. Other portions are also identical to those of the embodiment shown in FIGS. 4 to 6.

In the operation of this embodiment, the power transmission shaft 22 rocks around the axis of the horizontal shaft 30 through the connecting member 14, as the drive shaft 10 outside the furnace is moved up and down. In consequence, the rack 28 meshing with the gear 29 is moved horizontally. The movement of the rack 28 causes the pinion 31 to rotate which in turn causes a rotation of the lever 24a. In consequence, the material distributing hopper 9 together with the hopper support member 6 rotate around the Y-axis, through the action of the link 26, lever 25 and the shaft 7.

Also, as the drive shaft 10 rotates, the material distributing hopper 9 makes a rotary motion similar to that in the embodiment shown in FIGS. 4 to 6, by the combination of the rocking of the shaft 27 around the X-axis and the movement of the rack 28 caused by the rotation of the horizontal shaft 30, so that the lower end of the hopper 9 scribes a circle. At the same time, as the drive shaft 10 is moved up and down, the radius of the circle scribed by the lower end of the material distributing hopper 9 is changed.

Figure 10:
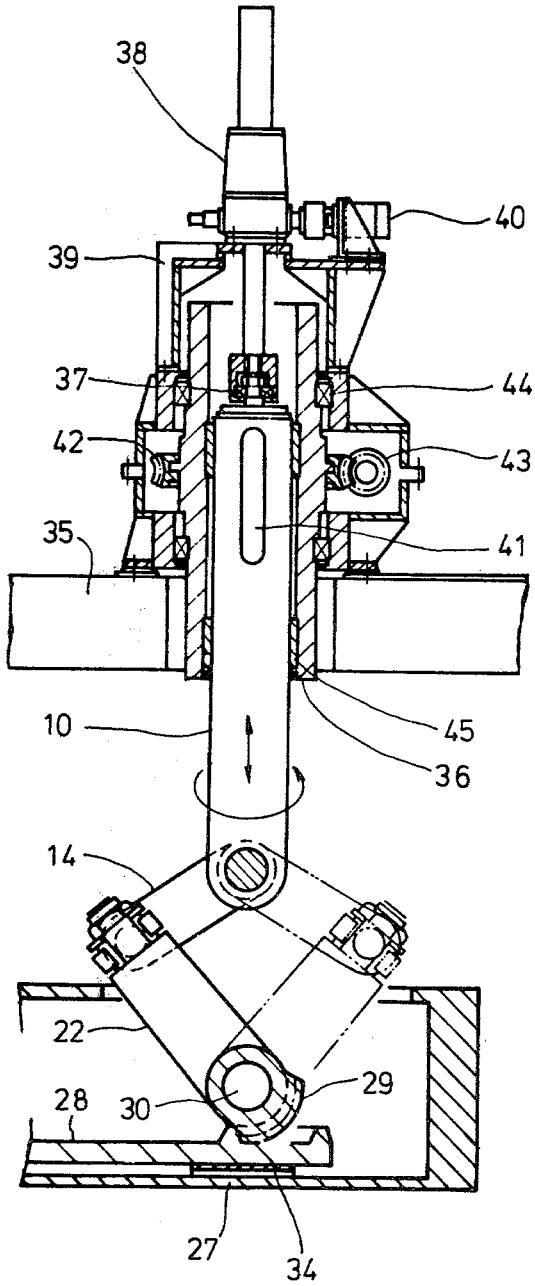
FIG. 10 is a sectional view of a driving power source section of the material distributing apparatus in accordance with the invention.

FIG. 10 shows an example of the arrangement of driving source outside the furnace, in accordance with the invention. The arrangement is such that the single drive shaft 10 in a material distributing apparatus of a single-drive-shaft type as in the preceding embodiments is adapted to be moved linearly up and down and rotated, as will be seen from the following description.

A worm jack 38 is rotatably connected at the lower end of the shaft thereof to the upper end of the single drive shaft 10, through a rotary universal joint 37 such as a spherical bush, so that the rotation of the drive shaft 10 is not transmitted to the shaft of the worm jack 38. The worm jack 38 is mounted on the top of the frame 39 carried by the turret 35 through which extended is a drive shaft 10. The drive shaft 10 is linearly moved up and down by the worm jack 38 as the latter is actuated by a worm jack actuator 40 which is mounted on the frame 39. Also, a boss 36 is unitarily fitted to the outer periphery of the drive shaft 10 through the medium of a slide key 41, so that the drive shaft 10 rotates unitarily with the boss 36 but is allowed to slide in the axial direction relatively to the boss 36.

A worm wheel 42 is fixed to the boss 36 and is engaged by a worm 43 which is connected to a worm drive device (not shown).

The rotation of the worm 43 is transmitted to the worm wheel 42 and the boss 36, so that the drive shaft 10 is rotated through the action of the key 41. Reference numerals 44 and 45 denote the bearing for the boss 36 and a bush, respectively.

According to this construction, the drive shaft 10 is moved up and down to impart a tilting motion to the material distributing hopper 9, through actuating the worm jack 38 by means of the worm jack actuating device 40.

For rotating the drive shaft 10 to impart a rotary motion to the material distributing hopper 9, the worm wheel 42 is rotated through the rotation of the worm 43. In consequence, the boss 36 is rotated so that the drive shaft 10 connected to the boss 36 by the slide key 41 is rotated.

Thus, the vertical movement of the drive shaft 10 and the rotation of the same are effected independently. If these operations are made simultaneously, the drive shaft 10 rotates while making a vertical movement, so that the material can be distributed in a spiral manner. It is possible to distribute the material in a ring-like pattern of desired radii, by actuating the worm jack 38 in a stepped manner at a desired pitch.

Although specific embodiments have been described, these embodiments are not exclusive and can be modified in various ways. For instance, the combination of rack and pinion in the embodiment shown in FIGS. 7 to 9 may be substituted by a link mechanism. Also, the driving mechanism for the drive shaft 10 shown in FIG. 10, which is described in connection with the embodiment shown in FIGS. 7 to 9, can equally be applied to the embodiment shown in FIGS. 1 to 3, as well as to the embodiment shown in FIGS. 4 to 6. Needless to say, the driving mechanism shown in FIG. 10 can be applied to any other apparatus adopting a single-shaft-driving type rocking system.

The apparatus of the invention having the described construction offers the following effects and advantages.

(i) Since the rocking of the material distributing hopper around the furnace axis and the radial rocking of the same are performed by a single shaft, the mechanisms required in the conventional 2-shaft type apparatus for synchronous driving of two shafts is eliminated to simplify the construction of the apparatus as a whole.

(ii) Since the drive shaft is disposed vertically, the construction for transmitting the power to the material distributing hopper is simplified.

(iii) The continuous operation of the drive shaft for causing the rocking of the material distributing hopper reduces the shock or impact given to the apparatus, whereby long apparatus life is obtained.

(iv) Since the driving source for driving the drive shaft is disposed outside the furnace, the inspection is facilitated and the frame can be sufficiently cooled by water cooling or the like measure against the thermal load. The running cost is therefore reduced as compared with the case of $N_2$ gas cooling.

(v) The construction is simplified and the production cost is reduced while achieving a high reliability, because the drive shaft is driven such that the vertical linear movement and the rotation are effected independently, while the driving part is kept stationary.

(vi) The distribution of the materials can be made at any desired pattern of distribution simply by effecting the vertical linear movement and the rotation of the drive shaft independently or simultaneously in combination.

What is claimed is:

1. An apparatus for distributing materials into a vertical type furnace comprising: a ring-shaped frame supported in a furnace top casing through which the material throw-in duct passes, said frame being mounted for rocking in one direction; a material distributing hopper supported by said frame for rocking in a direction perpendicular to the direction of rocking of said frame; a vertical drive shaft connected to a driving source outside said furnace and extending through said casing, said drive shaft being mounted rotatably and movably in the axial direction; and means connecting said drive shaft to said material distributing hopper for translating selected rotary and axial movment of said drive shaft into corresponding movement of said hopper.

2. An apparatus for distributing materials into a vertical type furnace as claimed in claim 1, wherein said drive shaft is disposed on the central axis of said furnace and wherein said means for connecting said drive shaft and said material distributing hopper includes a slipping coupling having a connecting member connected to said drive shaft and a shaft fixed to said material distributing hopper.

3. An apparatus for distributing materials into a vertical type furnace as claimed in claim 1, wherein said drive shaft is offset from the central axis of said furnace and wherein said means for connecting said drive shaft and said material distributing hopper includes a link mechanism which interconnects said material distributing hopper and a horizontal shaft provided at a point on said frame constituting the rocking center, and a slipping coupling between said horizontal shaft and said drive shaft.

4. An apparatus for distributing materials into a vertical type furnace as claimed in claim 1, wherein said drive shaft is disposed outside said furnace, wherein said frame mounts on a rocker shaft constituting the rocker center of said frame and extended to the outside of said furnace, and wherein said means for connecting said drive shaft and said material distributing hopper includes a horizontal shaft connected to a point of said rocking shaft extended to the outside of said furnace and connected also to said material distributing hopper, and a slipping coupling disposed outside said furnace and provided between said horizontal shaft and said drive shaft.

5. An apparatus for distributing materials into a vertical type furnace as claimed in claim 1, wherein the driving source outside said furnace includes a boss engaged by said drive shaft in such a manner that the torque is transmitted therebetween but said drive shaft is allowed to move in the axial direction relatively to said boss; means for causing an axial movement of said drive shaft; a rotatable universal joint through which said drive shaft is connected to said means for causing the axial movement of said drive shaft; and means for rotating said drive shaft connected to said boss.

6. An apparatus for distributing materials into a vertical type furnace as claimed in claim 2 wherein said drive shaft is disposed on the central axis of said furnace.

7. An apparatus for distributing materials into a vertical type furnace as claimed in claim 1 wherein said corresponding movement of said hopper simulates a pestle-like motion.

* * * * *